United States Patent [19]

Takami

[11] Patent Number: 4,559,767

[45] Date of Patent: Dec. 24, 1985

[54] APPARATUS FOR REGULATING THE TENSION OF A STRAP IN A PACKAGE STRAPPING MACHINE

[75] Inventor: Masaho Takami, Hirakata, Japan

[73] Assignee: Shoko Kiko Co., Ltd., Shijo Nawate, Japan

[21] Appl. No.: 672,165

[22] Filed: Nov. 16, 1984

Related U.S. Application Data

[63] Continuation of Ser. No. 456,290, Jan. 6, 1983, abandoned.

[30] Foreign Application Priority Data

Jan. 8, 1982 [JP] Japan ..... 57-2115
Jan. 13, 1982 [JP] Japan ..... 57-5304

[51] Int. Cl.[4] ..... B65B 13/04; B65B 13/22
[52] U.S. Cl. ..... 53/589; 100/32
[58] Field of Search ..... 53/399, 582, 589; 100/26, 29, 32; 226/25, 44, 48

[56] References Cited

U.S. PATENT DOCUMENTS

| | | | |
|---|---|---|---|
| Re. 31,353 | 8/1983 | Cheung | 53/589 |
| 3,442,734 | 5/1969 | Ericsson | 53/399 |
| 3,944,460 | 3/1976 | Karr | 53/582 |
| 3,984,278 | 10/1976 | Styner et al. | 53/582 |
| 4,062,278 | 12/1977 | Cheung | 53/582 |
| 4,155,799 | 5/1979 | Matsushita | 53/589 |
| 4,271,655 | 6/1981 | Nagayoshi | 53/589 |

FOREIGN PATENT DOCUMENTS 1161827 11/1966 United Kingdom ..... 100/26

*Primary Examiner*—Robert L. Spruill
*Assistant Examiner*—Michael D. Folkerts
*Attorney, Agent, or Firm*—Wenderoth, Lind & Ponack

[57] ABSTRACT

An apparatus for regulating the tension of a strap wound around a package on a package strapping machine. The apparatus has a frame having a package support surface provided with a strap guiding frame into which the package is inserted and into which the strap is fed to form a strap loop around the package, a driving roller rotatably mounted on the frame for bearing against the strap and rotatable in a direction for tensioning the strap to tighten the strap around the inserted package, a press roller movable toward and away from the driving roller for holding the strap in driving engagement against the driving roller or releasing it therefrom, the press roller pressure being adjustable. A strap conduit is pivotally mounted on the frame for passing the strap from the driving roller to the strap guiding frame, a linkage is movably mounted on the frame below the strap conduit, a spring has one end secured to the strap conduit and the other end secured to the linkages and a rod connects the linkage to the adjusting means and is movable for changing the tension of the spring for adjusting the pressure applied by the press roller to the driving roller.

2 Claims, 4 Drawing Figures

APPARATUS FOR REGULATING THE TENSION OF A STRAP IN A PACKAGE STRAPPING MACHINE

This application is a continuation of now abandoned application Ser. No. 456,290, filed Jan. 6, 1983.

BACKGROUND OF THE INVENTION

The present invention relates to an apparatus for regulating the tension of a strap when it has been wound around a package in a package strapping machine.

In conventional package strapping machines, a thermoplastic strap is looped around a package, and the leading end of the strap is clamped. Then the strap looped around the package is tightened, and an intermediate portion of the strap is cut, and then the overlapping ends of the strap are heated, pressed together and welded so as to cause the package to be strapped.

In such conventional machines, the strap is fed to a strap guiding frame so as to be looped around the package, and the leading end of the strap is clamped. Then the strap is preliminarily tensioned so that it may be detached from the strap guiding frame and come to be directly wound around the package. Then the strap is fully tensioned around the package, and the overlapped portions of the strap are clamped. Then an intermediate portion of the strap is cut, and the overlapping ends of the strap are pressed together and welded. A cycle of the sequential operation ends with the next feeding the strap to the strap guiding frame.

In order to meet the needs of the full tensioning process, it is most common to dispose a strap tensioning mechanism along the path to be traveled by the strap, i.e., midway between a reel from which the strap is delivered and a table on which the package is placed. The strap tensioning mechanism includes a pair of rollers by which the strap is pulled back toward the reel when the strap has been directly wound around the package. One of this pair of rollers, by means of its connection with a spring, is urged toward the other so as to hold the strap therebetween during the full tensioning process. The strap tensioning mechanism further includes a strap conduit pivotally mounted on a pin so as to be pivoted in the vertical direction when the tension of the strap passing therethrough is changed. The upward momentum of the strap conduit is utilized for detecting the tension of the fully tensioned strap. The strap conduit is urged downwardly by a spring.

The trouble is that the tension of the strap to be obtained in the full tensioning process varies with the kinds of packages and straps. In order to change the tension of the strap so as to adjust it to a specific kind of package or strap, it has been a common practice that the tension of the spring by which one of the pair of rollers is urged toward the other and the tension of the spring by which the strap conduit is urged downwardly are changed separately. However, the work of separately changing the tension of two springs gives rise to difficulties and is time-consuming, and yet the adjustment can be made only with low accuracy.

For example, a switch for stopping the motor which is driving the rollers will be actuated before the tension of the strap comes up to a predetermined degree if the tension of the spring by which one of the pair of rollers is urged toward the other is increased to a disproportionately higher degree that the increase in the tension of the spring by which the strap conduit is urged downwardly. On the other hand, the rollers will slip on the surfaces of the strap during the full tensioning process if the tension of the spring by which the strap conduit is urged downwardly is increased to a disproportionately higher degree than the increase in the tension of the spring by which one of the pair of rollers is urged toward the other.

SUMMARY OF THE INVENTION

It is an object of the present invention to provide an apparatus for regulating the tension of a strap to be obtained in the full tensioning process, which method is characterized in that the pressure to be exerted on the strap by the rollers in the full tensioning process can be adjusted simultaneously with the adjustment of the limit of detection to be set in a means for detecting the tension of the fully tensioned strap.

According to the present invention, the above-described simultaneous adjustment is made by means of a single adjusting knob. When the degree of compression of the spring by which one of the pair of rollers is urged toward the other is changed by tightening or backing off the adjusting knob, the tension of the spring by which the strap conduit is urged downwardly is also changed in conformity therewith.

With the above-described object in view, the present invention will become apparent from the following detailed description, which will be more clearly understood in connection with the accompanying drawings.

DETAILED DESCRIPTION OF THE INVENTION

Figure 1:
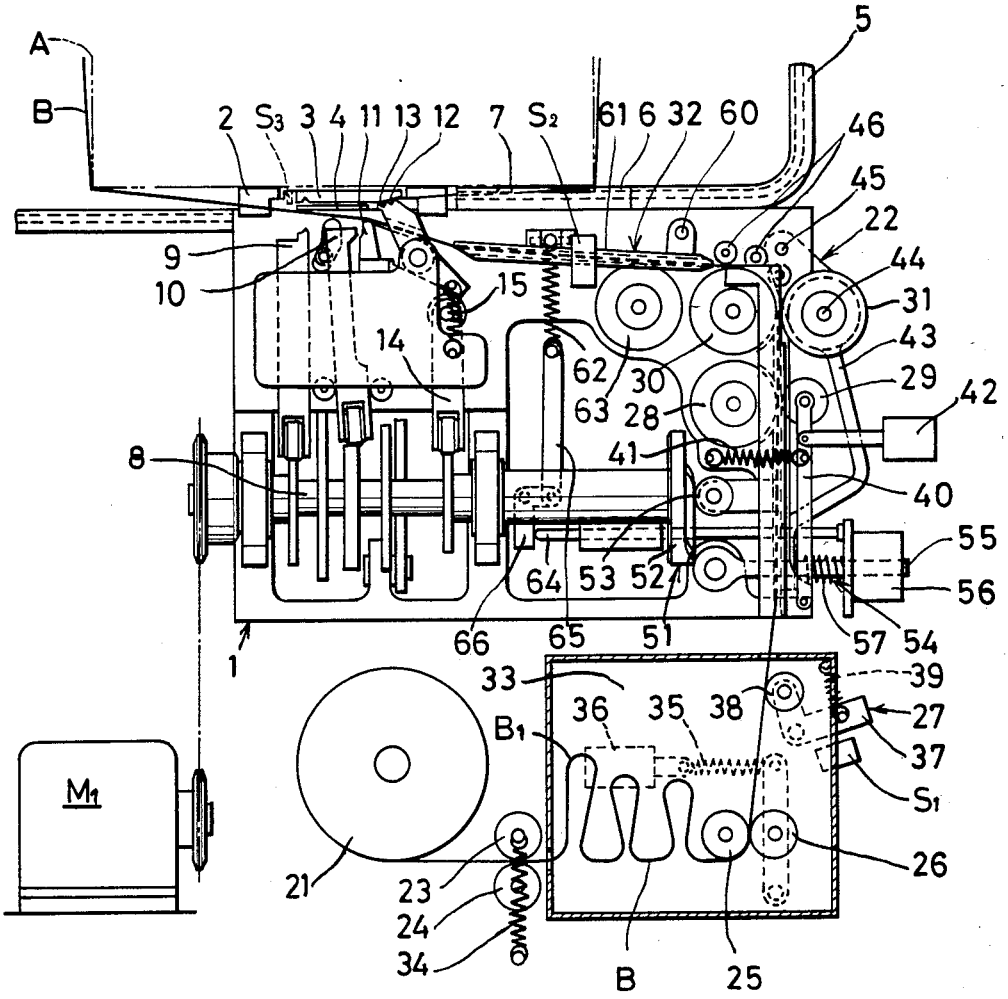
FIG. 1 is a front view of a package strapping machine embodying the present invention, in which the strap is preliminarily tensioned.

Referring to FIG. 1, an automatic package strapping machine of the present invention includes a frame 1 secured within a case on which a pacakge A to be strapped is loaded. A sliding plate 3 and a guide plate 4 are provided in the upper part of the frame 1. The sliding plate 3 is supported by supporting guides 2 so as to be horizontally movable. The guide plate 4 is provided under the sliding plate 3 in such a manner that some space is left between them and that the former is movable in the same direction as the latter. A strap guiding frame 5, which is substantially shaped like an inverted capital U, is provided so as to vertically surround the package A. A strap guiding member 6 is provided, by which the strap B is guided from the delivery end of the strap guiding frame 5 into the space between the sliding plate 3 and the guide plate 4. A groove provided in the strap guiding member 6 is opened and shut by a cover 7.

The sliding plate 3 is of a double-acting type, i.e., it is capable of primary and secondary recessions by means of a cam mechanism. The movement of the guide plate 4 and the cover 7 is synchronized with that of the sliding plate 3. At the time of the primary recession of the sliding plate 3, the cover 7 is opened so as to open the groove provided in the strap guiding member 6.

The guide plate 4 is shorter than the sliding plate 3 so that the former will not be a hinderance to the clamping, welding and cutting processes to which the strap is subjected when the guide plate 4 recedes from its operative position at the time of the primary recession.

A cam shaft 8 driven by a motor $M_1$ is provided in the lower part of the frame 1. Between the cam shaft 8 and the sliding plate 3 are arranged in a line from left to right: a second clamp 9 which is movable up and down so that, when it is in its uppermost position, the overlapping portions of the strap B are clamped between the top of the second clamp 9 and the under surface of the sliding plate 3; a pressing device 10 which is likewise movable up and down; a lower cutting edge 11 which is stationary and adapted for cutting an intermediate portion of the strap B; a first clamp 12 pivotally mounted on a pin so as to be rockable in the longitudinal direction of the strap B and adapted for pressing the leading end of the strap B against the under surface of the sliding plate 3; an upper cutting edge 13 provided at the upper end portion of the first clamp 12 and adapted to cut the strap B in co-operation with the lower cutting edge 11; a rod 14 which is movable up and down so as to impart pivotal motion to the first clamp 12; and a spring 15 by which the upper cutting edge 13 is urged upwardly.

A heater (not shown) is inserted between the sliding plate 3 and the pressing device 10 when the guide plate 4 has been withdrawn therefrom.

The up-and-down movement of the second clamp 9, the horizontal movement of the heater, the up-and-down movement of the pressing device 10, the horizontal movement of the sliding plate 3, and the up-and-down movement of the rod 14 are synchronized by the use of cams mounted on the cam shaft 8.

A reel 21 wound with strap B is disposed under the frame 1. The strap B is pulled out from the reel 21 and advanced under the guide plate 4 and then into the strap guiding frame 5. A strap forwarding and tensioning mechanism 22 is disposed along the path to be traveled by the strap B.

Components of the strap forwarding and tensioning mechanism 22 are arranged between the reel 21 and the guide plate 4. In increasing order of distance from the reel 21, these components are: a pair of nip rollers 23 and 24; rollers 25 and 26 for forwarding and preliminarily tensioning the strap; a means 27 for detecting the tension of the preliminarily tensioned strap; rollers 28 and 29 for the exclusive use in forwarding the strap; rollers 30 and 31 for fully tensioning the strap; and a means 32 for detecting the tension of the fully tensioned strap. Space 33 for accommodating the stand-by portions of the strap B is provided at the feed and delivery sides of the rollers 25 and 26.

The nip rollers 23, by means of its connection with a spring 34, is urged toward the nip roller 24 so as to hold the moving strap B against the nip roller 24.

The roller 26 is connected with a solenoid 36 through a spring 35. When the spring 35 is pulled by the solenoid 36 at the time of preliminary tensioning, the roller 26 comes to be pressed against the roller 25 so that these rollers become capable of exerting tractive force on the strap B for preliminary tensioning.

The means 27 for detecting the tension of the preliminarily tensioned strap is interposed between the pair of rollers 28, 29 and the pair of rollers 25, 26. The means 27 includes an L-shaped pivotable holder 37 which carries a rotatably mounted roller 38. A spring 39 normally tends to urge the roller 38 against the strap B. When the strap B is preliminarily tensioned, it will pivot the holder 37 and thereby actuate a switch $S_1$ for starting the motor $M_1$ so as to subject the strap B to full tensioning.

A spring 41 normally tends to urge the driven roller 29, which is rotatably mounted on the upper end of a rocker arm 40, against the driving roller 28. Except in the strap forwarding process, however, a solenoid 42 is kept energized so that some space is left between the rollers 28 and 29.

Rollers for fully tensioning the strap comprise a driving roller 30 and a press roller 31, the latter being rotatably mounted on a holder 43 by a shaft 44 and adapted to be pressed against the driving roller 30.

A pin 45 for pivotally mounting the holder 43 is provided above the driving roller 30 on the frame 1. The holder 43 extends downwardly from the pin 45 in a suspended state.

The press roller 31 is mounted in the proximity of the upper end of the holder 43 so as to be substantially on the same level with the driving roller 30. Because the holder 43 can be pivoted on the pin 45, the press roller 31 is separable from the driving roller 30.

The strap B is drawn out of the reel 21, forwarded by the rollers 25 and 26, upwardly thrust into the space between the rollers 30 and 31, guided by guide rollers 46 so as to make a turn along the cylindrical surface of the driving roller 30, and advanced into the means 32.

Figure 4:
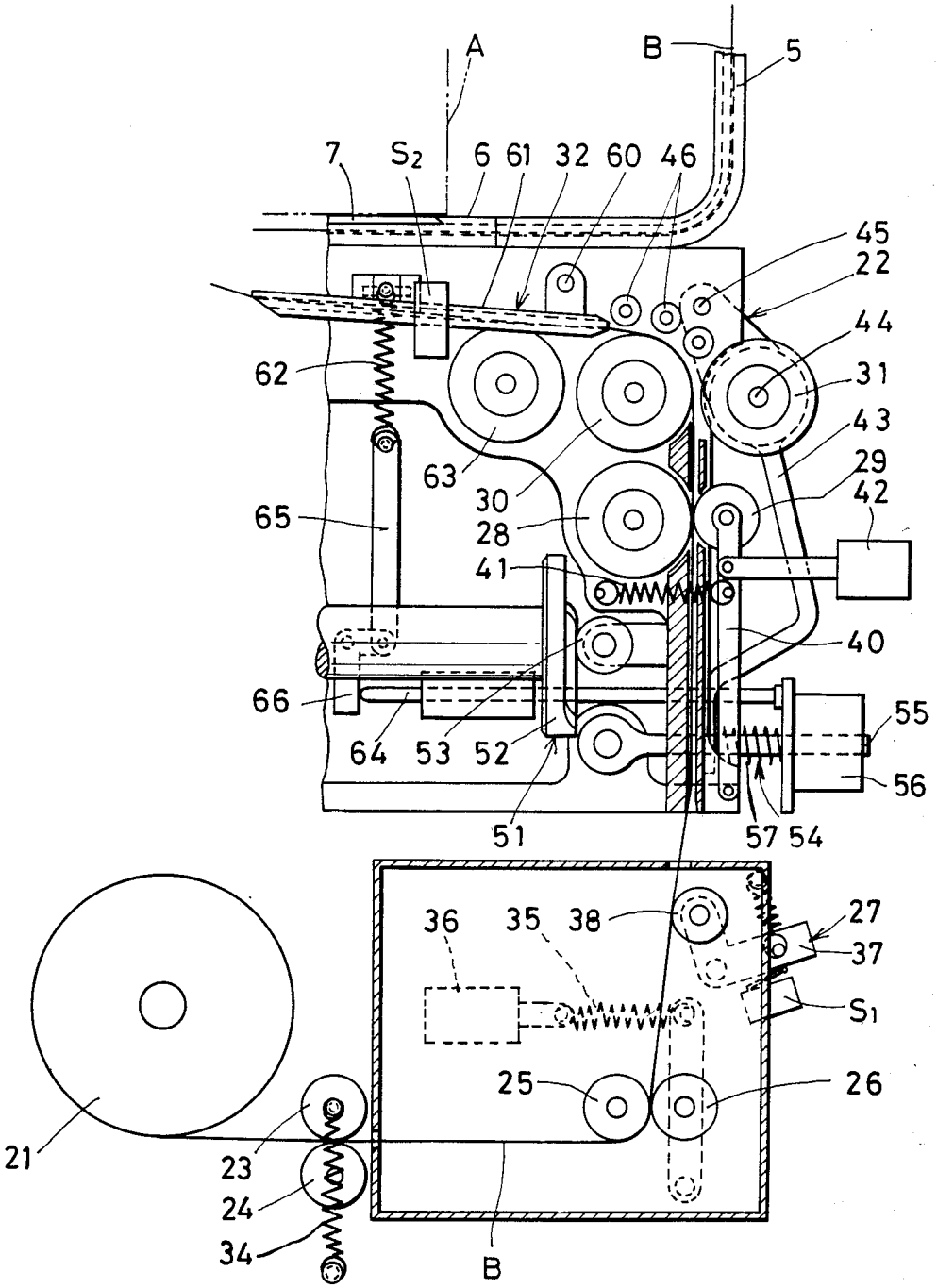
FIG. 4 is a front view of a part thereof, in which the machine is in the strap feeding process.

The press roller 31 is pressed against the driving roller 30 by means of a cam mechanism 51 only when the driving roller 30 is rotated in the clockwise direction so as to tension the strap B. Except in the strap tensioning process, the press roller 31 is separated from the driving roller 30 so that some space is left therebetween for allowing the strap B to pass therethrough as shown in FIG. 4.

The cam mechanism 51 for pivoting the press roller 31 includes a cam 52 mounted on the end of the cam shaft 8, a roller 53 rotatably mounted on the lower end portion of the holder 43 so as to remain in contact with the cam 52, and a pressure regulator 54 for adjusting the pressure applied by the press roller 31 to the driving roller 30.

The cam 52 has a projecting portion and a base portion. As long as the roller 53 remains in contact with the projecting portion of the cam 52, the press roller 31 is kept in such a position as to leave a space between itself and the driving roller 30. The press roller 31 is caused to press against the driving roller 30 when the roller 53 comes in contact with the base portion of the cam 52 at the beginning of the full tensioning process.

The pressure regulator 54 includes a threaded rod 55 pivotally mounted on the frame 1 and extending outwardly through a hole provided in the lower part of the holder 43. The pressure regulator 54 further includes an adjusting knob 56 tapped to engage the threaded end of the rod 55 and a spring 57 fitting over the rod 55 and engaging at opposite ends against the adjusting knob 56 and the holder 43 so as to be normally in compression therebetween. The pressure exerted on the strap B by the rollers 30 and 31 can be selected merely by tightening or backing off the adjusting knob 56 so as to change the degree of compression of the spring 57.

The means 32 for detecting the tension of the fully tensioned strap is disposed between the rollers 30, 31 and the upper cutting edge 13. The means 32 includes a strap conduit 61 pivotally mounted on a pin 60 so as to be rockable in the vertical direction. The strap conduit 61 will be pivoted when the tension of the strap B passing therethrough is changed. Then the upward momentum of the strap conduit 61 is utilized for detecting the tension of the fully tensioned strap. The means 32 further includes a switch $S_2$ for starting the motor $M_1$ for the strap welding process when the tension of the fully tensioned strap has been detected, a spring 62 by which the strap conduit 61 is urged downwardly, and a guide roller 63 provided under the strap conduit 61 in the intermediate portion thereof.

A rod 64 is provided, one end of which abuts the internal surface of the adjusting knob 56 while the other end abuts the vertical member of an L-shaped pivotable link 66. The horizontal member of the link 66 is connected with the lower end of the spring 62 through a link 65. Because of this arrangement, when the degree of compression of the spring 57 is changed by tightening or backing off the adjusting knob 56, the tension of the spring 62 is also changed in conformity therewith. Thus the pressure to be exerted on the strap B by the rollers 30 and 31 in the full tensioning process can be adjusted simultaneously with the adjustment of the limit of detection to be set to the means 32.

Figure 2:
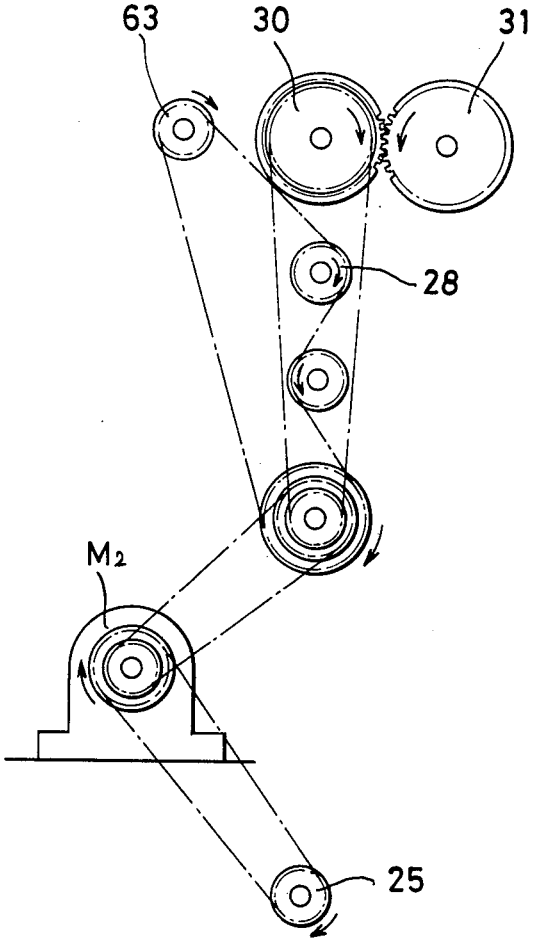
FIG. 2 is a diagram for explaining the driving of the rollers therein.

As shown in FIG. 2, the rollers 25 and 26 for forwarding and preliminarily tensioning the strap, the rollers 28 and 29 for the exclusive use in forwarding the strap, the rollers 30 and 31 for fully tensioning the strap, and the guide roller 63 are connected with each other by endless chains, endless belts, sprocket wheels, pulleys and gears so as to be driven by a motor $M_2$.

During the strap tensioning process, the rollers rotate in the directions indicated by arrows in FIG. 2. For the purpose of the strap forwarding process, the direction of rotation of the motor shaft is reversed in the motor $M_2$ so as to rotate the rollers in the directions opposite to those indicated by arrows in FIG. 2.

In operation, the strap B drawn out of the reel 21 is advanced into the strap guiding frame 5, and the leading end of the strap B is thrust into the space between the sliding plate 3 and the guide plate 4 to the extent that it pushes a limit switch $S_3$ in preparation for the start of work.

Now the package A is placed on the table so as to be surrounded by the strap guiding frame 5. Then the starting switch is actuated to start the preparatory process.

In the preparatory process, the motor $M_1$ is energized and the cam shaft 8 is thereby rotated so as to subject the sliding plate 3, guide plate 4 and cover 7 to primary recession, which means that the guide plate 4 recedes from under the leading end portion of the strap and the groove provided in the strap guiding member 6 is opened.

Then the upper cutting edge 13 is elevated so as to allow the first clamp 12 to press the leading end portion of the strap B against the under surface of the sliding plate 3.

At the same time, the motor $M_2$ and the solenoids 36 and 42 are energized, the rollers 28 and 29 for the exclusive use in forwarding the strap are separated from each other, the strap B is nipped by the rollers 25 and 26 for forwarding and preliminarily tensioning the strap, and the shaft of the motor $M_2$ and the rollers rotate in the directions indicated by arrows in FIG. 2.

In this stage, the roller 53 remains in contact with the projecting portion of the cam 52 so as to keep the press roller 31 in such a position as to leave a space between itself and the driving roller 30 as shown in FIG. 4.

Then the preliminary tensioning process begins, which is carried out by pulling the strap B toward the reel 21 by means of the rollers 25 and 26. The strap B is removed inwardly from within the strap guiding frame 5 and the strap guiding member 6 and caused to wind around the package A as shown in FIG. 1. The portion $B_1$ of the strap B slackened by the preliminary tensioning is stored in the space provided between the rollers 25, 26 and the nip rollers 23, 24 as shown in FIG. 1.

The preliminary tensioning process ends with the switch $S_1$ of the means 27 detecting the tension of the strap B which has come up to the degree predetermined for the preliminary tensioning.

Then the full tensioning process begins. The motor $M_1$ is again energized when the switch $S_1$ detects the tension of the strap B which has come up to the degree predetermined for the preliminary tensioning. Then the cam shaft 8 is rotated, and the motor $M_1$ stops when the roller 53 comes in contact with the base portion of the cam 52. Then the rollers 30 and 31 nip the strap B and pull it downward continuously with a larger magnitude of force than that with which the strap B was preliminarily tensioned.

Figure 3:
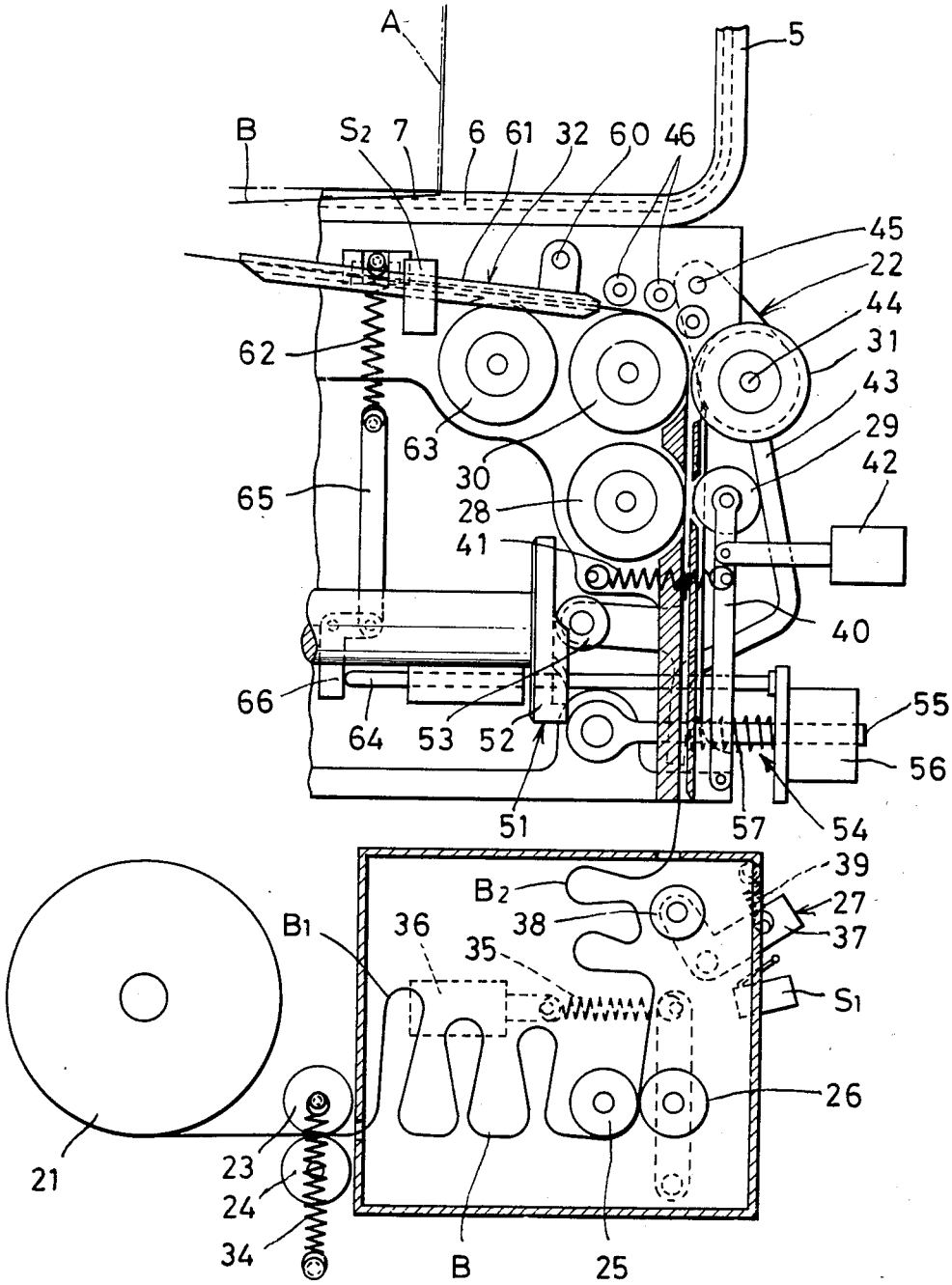
FIG. 3 is a front view of a part thereof, in which the strap is fully tensioned.

The solenoid 36 is de-energized simultaneously with the beginning of the full tensioning process. Then the rollers 25 and 26 are separated from each other. The portion $B_2$ of the strap B slackened by the full tensioning is stored in the space provided between the rollers 30, 31 and the rollers 25, 26 as shown in FIG. 3.

When the strap B is tensioned, it will upwardly pivot the strap conduit 61. The full tensioning process ends with the switch $S_2$ detecting the tension of the strap B which has come up to the degree predetermined for the full tensioning.

Then the cutting and welding process begins. The motor $M_1$ is started again and the motor $M_2$ is stopped by a signal given by the switch $S_2$.

When the cam shaft 8 is rotated by the motor $M_1$, the cams mounted on the cam shaft 8 begin to effect a series of operation. Firstly, the second clamp 9 is elevated to its uppermost position and clamps the overlapping portions of the strap B between its upper surface and the under surface of the sliding plate 3 so as to prevent the strap B from becoming loose. Then the rod 14 is elevated and causes the first clamp 12 to move counterclockwise in FIG. 1 so as to allow the upper cutting edge 13 to cut an intermediate portion of the strap B in cooperation with the lower cutting edge 11.

When the strap B has been cut, the heater (not shown) is inserted between the overlapping end portions of the strap B. Then the pressing device 10 is elevated and presses the overlapping end portions of the strap B against the under surface of the sliding plate 3, with the heater held between the overlapping end portions of the strap B. The pressing causes suitable contact of the heater with the overlapping strap surfaces, thereby suitably fusing the strap surfaces.

The heater, upon completion of the strap melting, is withdrawn from between the overlapping portions. After withdrawal of the heater, the pressing continues until the overlapping portions become welded.

Then the pressing device 10 together with the second clamp 9 descend to their initial positions, followed by the secondary recession of the sliding plate 3 from between the package A and the strap B. Now the package A can be taken away from the table.

The cam shaft 8 makes exactly one revolution in the time interval between the initial starting of the motor $M_1$ and the end of the welding process. The sliding plate 3, guide plate 4 and cover 7 return to their initial positions simultaneously with the separation of the rollers 30 and 31 from each other because of the roller 53 coming in contact with the projecting portion of the cam 52.

When the cam shaft 8 has made exactly one revolution, the motor $M_2$ is started and the motor shaft rotated in the direction opposite to that shown in FIG. 2. At the same time, the solenoid 36 is energized so as to cause the rollers 25 and 26 to nip the strap B, while the solenoid 42 is de-energized for the start of the strap forwarding process.

In the strap forwarding process, a length of the strap B has to be pulled out from the reel 21 which is just equal to that which was used for the preceding package strapping operation. Thus the motor $M_2$ would instantaneously undergo a heavy load for setting a weighty reel in rotation if the strap B were to be pulled out directly from the reel 21 at the moment when the motor $M_2$ is started.

It is difficult to have the motor $M_2$ develop a rated torque immediately after starting when the motor has not yet attained the rated number of revolutions per minute. If, simultaneously with the starting, the motor $M_2$ is subjected to a heavy load for setting the reel 21 in rotation, the strap forwarding process will require a lot of time because of a low feed speed, and an inefficient package strapping operation will result therefrom.

Such a disadvantage is eliminated by the apparatus of the present invention, according to which stand-by or slackened portions $B_1$ and $B_2$ of the strap B are formed as shown in FIG. 3 at the end of the full tensioning process at the feed and delivery sides of the rollers 25 and 26. These portions $B_1$ and $B_2$ are the first to be forwarded when the motor $M_2$ is started with the motor shaft caused to rotate in the direction opposite to that shown in FIG. 2 so as to cause the rollers 25, 26 and the rollers 28, 29 to simultaneously forward the strap B. Thus the rollers 25, 26 and the rollers 30, 31 are in a condition of no-load running when they forward the leading end portion of the strap B into the strap guiding frame 5.

As a matter of course, the stand-by or slackened portions $B_1$ and $B_2$ are not long enough to allow the leading end of the strap B to cover the full length of the passage designed therefor. The deficiency has to be filled up by pulling out the strap B from the reel 21. In this connection, the apparatus of the present invention has an advantage that the portions $B_1$ and $B_2$ permit the passage of some time before the motor $M_2$ begins to be subjected to a heavy load for setting the reel 21 in rotation. During the passage of this time, the motor shaft gathers speed sufficient to develop a torgue which is large enough to pull out the strap B from the reel 21. Therefore, the strap guiding frame 5 can be fed with the strap B at high speed and the package strapping operation can be performed efficiently.

The motor $M_2$ stops and all the steps of which the package strapping operation is made up, are finished when the strap B has passed through the strap guiding frame 5 and the leading end portion of strap B has been thrust into the space between the sliding plate 3 and the guide plate 4 to the extent of pushing the limit switch $S_3$.

While a preferred embodiment of the present invention has been disclosed, it is to be understood that it has been described by way of example only, various other modifications being obvious.

What I claim is:

1. An apparatus for regulating the tension of a strap wound around a package on a package strapping machine, said apparatus comprising:

a frame having a package support surface provided with a strap guiding frame into which the package is inserted and into which the strap is fed to form a strap loop around the package;

a driving roller rotatably mounted on said frame below said package support surface for bearing against the strap and rotatable in a direction for tensioning the strap to tighten the strap around the inserted package;

a press roller movable toward and away from said driving roller for holding the strap in driving engagement against said driving roller or releasing it from such driving engagement;

adjusting means connected to said press roller for adjusting the pressure of said press roller on said driving roller;

a strap conduit pivotally mounted on said frame for passing the strap from said driving roller to said strap guiding frame;

link means movably mounted on said frame below said strap conduit;

a spring having one end secured to said strap conduit and the other end secured to said link means; and a rod connecting said link means to said adjusting means and movable by said adjusting means for changing the tension of said spring when said adjusting means is actuated for adjusting the pressure applied by said press roller to said driving roller.

2. An apparatus as claimed in claim 1 wherein said link means comprises an L-shaped link pivoted on said frame and having a horizontal member to which the other end of said spring is connected and a vertical member to which said rod is connected.

* * * * *